US010801260B2

(12) United States Patent
Whitmire et al.

(10) Patent No.: US 10,801,260 B2
(45) Date of Patent: Oct. 13, 2020

(54) MOTORIZED WINDOW COVERING HAVING POWERED MODULES

(71) Applicant: TTI (MACAO COMMERCIAL OFFSHORE) LIMITED, Macau (MO)

(72) Inventors: J. Porter Whitmire, Greenville, SC (US); Mark Huggins, Anderson, SC (US); Tanvi Singh, Pune (IN); J. Luke Jenkins, Anderson, SC (US)

(73) Assignee: TTI (MACAO COMMERCIAL OFFSHORE) LIMITED, Macau (MO)

( * ) Notice: Subject to any disclaimer, the term of this patent is extended or adjusted under 35 U.S.C. 154(b) by 0 days.

(21) Appl. No.: 15/956,576

(22) Filed: Apr. 18, 2018

(65) Prior Publication Data

US 2018/0305979 A1 Oct. 25, 2018

Related U.S. Application Data

(60) Provisional application No. 62/487,376, filed on Apr. 19, 2017.

(51) Int. Cl.

| | |
|---|---|
| ***E06B 9/70*** | (2006.01) |
| ***E06B 9/322*** | (2006.01) |
| ***E06B 9/50*** | (2006.01) |
| ***E06B 9/42*** | (2006.01) |
| *E06B 9/262* | (2006.01) |

(52) U.S. Cl.

CPC ..... *E06B 9/70* (2013.01); *E06B 9/322* (2013.01); *E06B 9/42* (2013.01); *E06B 9/50* (2013.01); *E06B 2009/2627* (2013.01)

(58) Field of Classification Search

CPC ..... E06B 9/70; E06B 9/72; E06B 9/68; E06B 2009/6818

See application file for complete search history.

(56) References Cited

U.S. PATENT DOCUMENTS

| | | | | |
|---|---|---|---|---|
| 5,148,849 | A * | 9/1992 | Faludy | B60P 3/343 160/10 |
| 6,674,255 | B2 * | 1/2004 | Schnebly | E06B 9/32 318/16 |
| 6,850,017 | B1 * | 2/2005 | Domel | E06B 9/307 318/400.29 |
| 6,983,783 | B2 * | 1/2006 | Carmen, Jr. | E06B 9/68 160/120 |
| 7,281,561 | B2 * | 10/2007 | Anderson | E06B 9/264 160/121.1 |

(Continued)

FOREIGN PATENT DOCUMENTS

| | | | | |
|---|---|---|---|---|
| CA | 3002228 | A1 * | 10/2018 | E06B 9/42 |
| JP | 2004012818 | A * | 1/2004 | |

OTHER PUBLICATIONS

Shimada Junzo, English translation of "JP2004012818A", obtained from <https://worldwide.espacenet.com/?locale=en_EP>. (Year: 2004).*

*Primary Examiner* — Johnnie A. Shablack

(74) *Attorney, Agent, or Firm* — Morgan, Lewis & Bockius, LLP

(57) ABSTRACT

A window covering assembly includes one or more powered modules, such as a light, temperature sensor, fan, heater, or motion detector. The window covering assembly is configured so that the modules may be attached to the window covering assembly in numerous configurations, thus permitting tailored features of the window covering assembly.

7 Claims, 3 Drawing Sheets

(56) References Cited

U.S. PATENT DOCUMENTS 7,338,050 B1 * 3/2008 Tellez ..... E04B 1/68 277/616
7,931,068 B2 * 4/2011 Carmen, Jr. ..... E06B 9/68 160/120
8,307,878 B2 * 11/2012 Faller ..... E06B 9/322 160/310
8,417,388 B2 * 4/2013 Altonen ..... E06B 9/68 700/278
8,571,719 B2 * 10/2013 Altonen ..... E06B 9/68 160/5
8,659,246 B2 * 2/2014 Mullet ..... E06B 9/40 318/255
8,666,555 B2 * 3/2014 Altonen ..... E06B 9/68 700/275
8,723,454 B2 * 5/2014 Skinner ..... E06B 9/322 318/16
8,866,343 B2 * 10/2014 Abraham ..... E06B 9/68 307/85
8,901,769 B2 * 12/2014 Altonen ..... E06B 9/68 307/31
8,946,924 B2 * 2/2015 Pessina ..... E06B 9/68 307/9.1
8,947,027 B2 * 2/2015 Mullet ..... H02P 3/08 318/255
8,975,778 B2 * 3/2015 Altonen ..... H02J 3/12 307/31
9,013,059 B2 * 4/2015 Altonen ..... E06B 9/68 307/31
9,124,130 B2 * 9/2015 Altonen ..... H05B 37/02
9,152,032 B2 * 10/2015 Mullet ..... E06B 9/62
9,169,690 B2 * 10/2015 Blair ..... E06B 9/24
9,249,623 B2 * 2/2016 Mullet ..... E06B 9/42
9,267,327 B2 * 2/2016 Feldstein ..... G05B 11/01
9,366,082 B2 * 6/2016 Feldstein ..... G05B 11/01
9,410,371 B2 * 8/2016 Faller ..... E06B 9/322
9,670,725 B2 * 6/2017 Gill ..... E06B 9/11
9,745,797 B2 * 8/2017 Mullet ..... E06B 9/42
9,970,669 B2 * 5/2018 Chang ..... F24F 5/0042
9,991,710 B2 * 6/2018 Altonen ..... H02J 3/12
10,113,360 B2 * 10/2018 Hall ..... E06B 9/80
10,119,330 B2 * 11/2018 Brunk ..... E06B 9/72
10,358,869 B2 * 7/2019 Feldstein ..... E06B 9/68
10,514,963 B2 * 12/2019 Shrivastava ..... G06F 9/54
10,520,784 B2 * 12/2019 Brown ..... G02F 1/15
2005/0022946 A1 * 2/2005 Domel ..... E06B 9/322 160/168.1 P
2007/0187042 A1 * 8/2007 Kallstrom ..... E06B 9/88 160/7
2007/0284053 A1 * 12/2007 Mullet ..... E06B 9/42 160/31
2008/0053628 A1 * 3/2008 Anderson ..... E06B 9/264 160/238
2008/0236763 A1 * 10/2008 Kates ..... E06B 9/32 160/5
2009/0308543 A1 * 12/2009 Kates ..... E06B 9/44 160/5
2011/0283632 A1 * 11/2011 Sutton ..... A47B 46/005 52/36.1
2012/0285666 A1 * 11/2012 Klimaszewski ..... E06B 7/10 165/104.34
2014/0045419 A1 * 2/2014 Bartmann ..... E06B 7/12 454/198
2014/0090787 A1 * 4/2014 Colson ..... E06B 9/82 160/7
2015/0191959 A1 * 7/2015 Schmohl ..... E06B 9/24 160/6
2015/0234369 A1 * 8/2015 Wen ..... H05B 39/042 700/278
2016/0054023 A1 * 2/2016 Baker ..... E04F 19/00 307/31
2018/0223596 A1 * 8/2018 Hall ..... E06B 9/44
2018/0305978 A1 * 10/2018 Whitmire ..... E06B 9/266
2018/0305979 A1 * 10/2018 Whitmire ..... E06B 9/42
2018/0347272 A1 * 12/2018 Gill ..... E06B 9/11
2019/0024452 A1 * 1/2019 Derk, Jr. ..... E06B 9/72
2019/0128053 A1 * 5/2019 Patel ..... F24F 3/1603
2019/0145166 A1 * 5/2019 Campagna ..... E06B 9/72 160/310
2019/0218859 A1 * 7/2019 Campagna ..... E06B 9/72
2019/0226275 A1 * 7/2019 Miller ..... H02S 40/38
2019/0271155 A1 * 9/2019 Gilbertson ..... E04B 2/967
2019/0384652 A1 * 12/2019 Shrivastava ..... G06F 9/54

* cited by examiner

MOTORIZED WINDOW COVERING HAVING POWERED MODULES

This application claims the benefit of U.S. Provisional Application No. 62/487,376, filed Apr. 19, 2017, the contents of which are hereby incorporated by reference in their entirety.

SUMMARY OF THE INVENTION

The present invention relates to a window covering assembly, and more particularly, to such an assembly that includes one or more powered modules. These modules may be a light, temperature sensor, fan, heater, or motion detector. A user is able to select the appropriate type and quantities of modules for a given window covering assembly.

DETAILED DESCRIPTION OF THE PREFERRED EMBODIMENT

Reference will now be made in detail to the preferred embodiment of the present invention, which is illustrated in the accompanying drawing.

Figure 1:
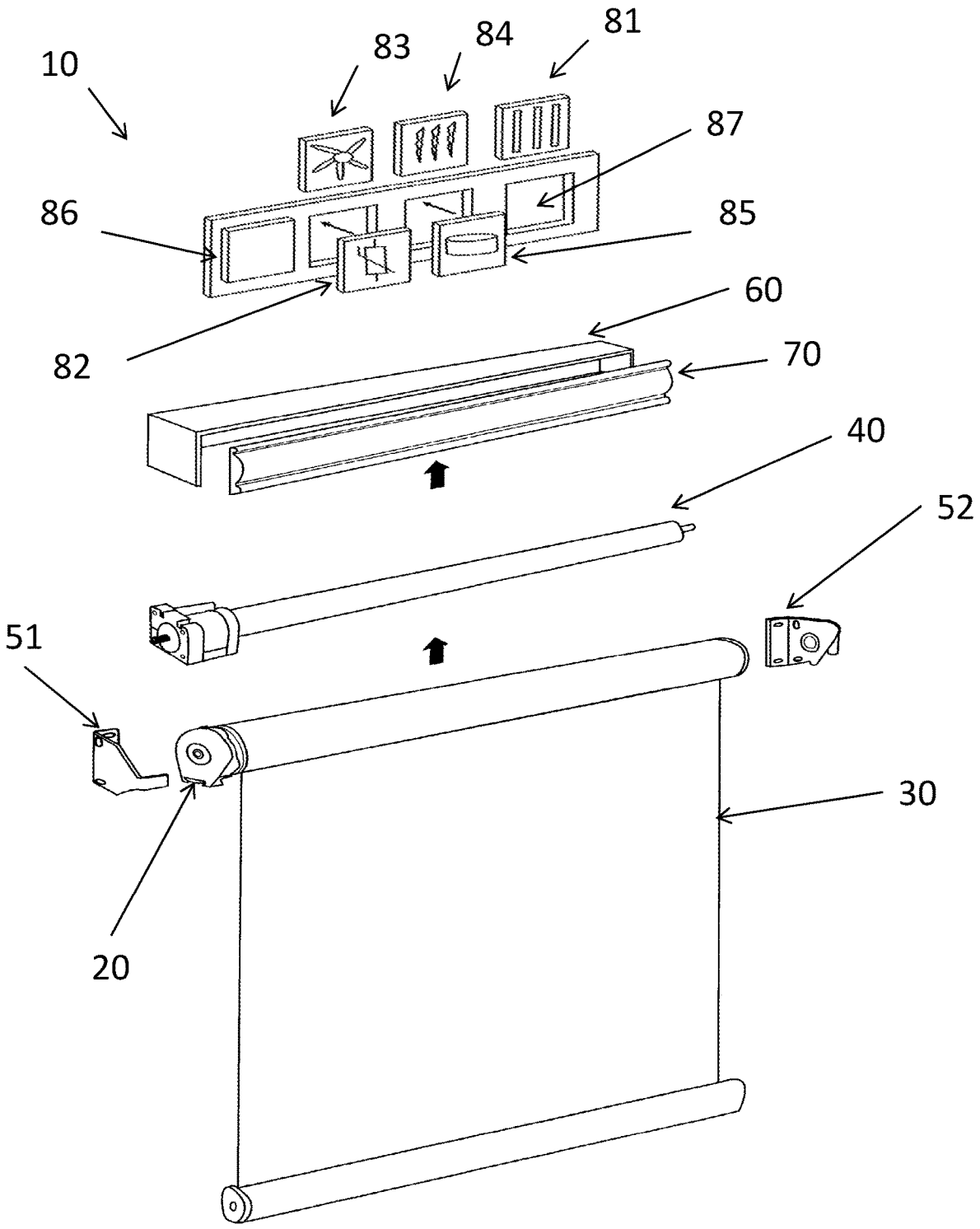
FIG. 1 is an exploded view of a window covering assembly according to one exemplary embodiment of the present invention.
Figure 2:
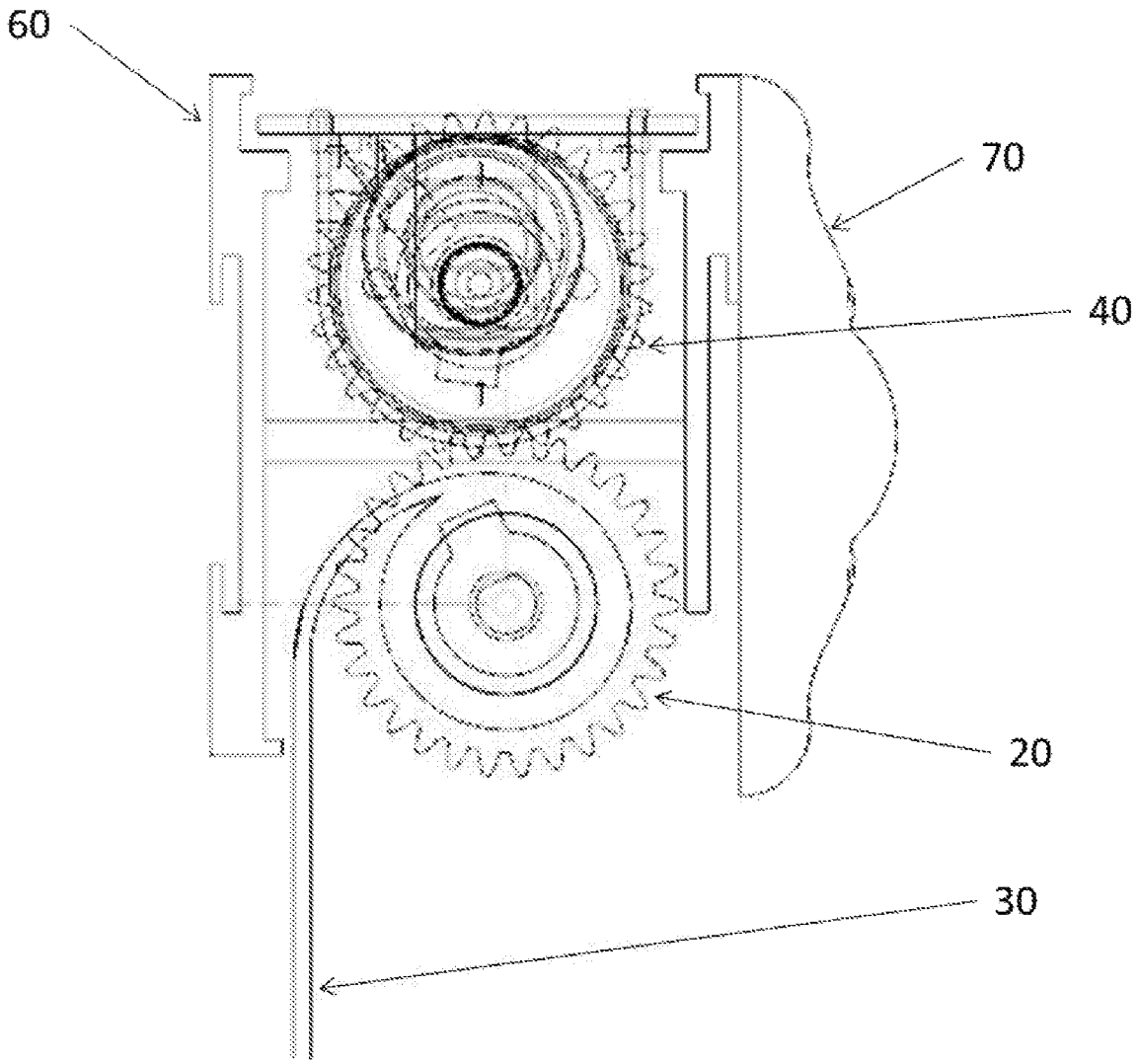
FIG. 2 is a side view of a window covering assembly according to one exemplary embodiment of the present invention.
Figure 3:
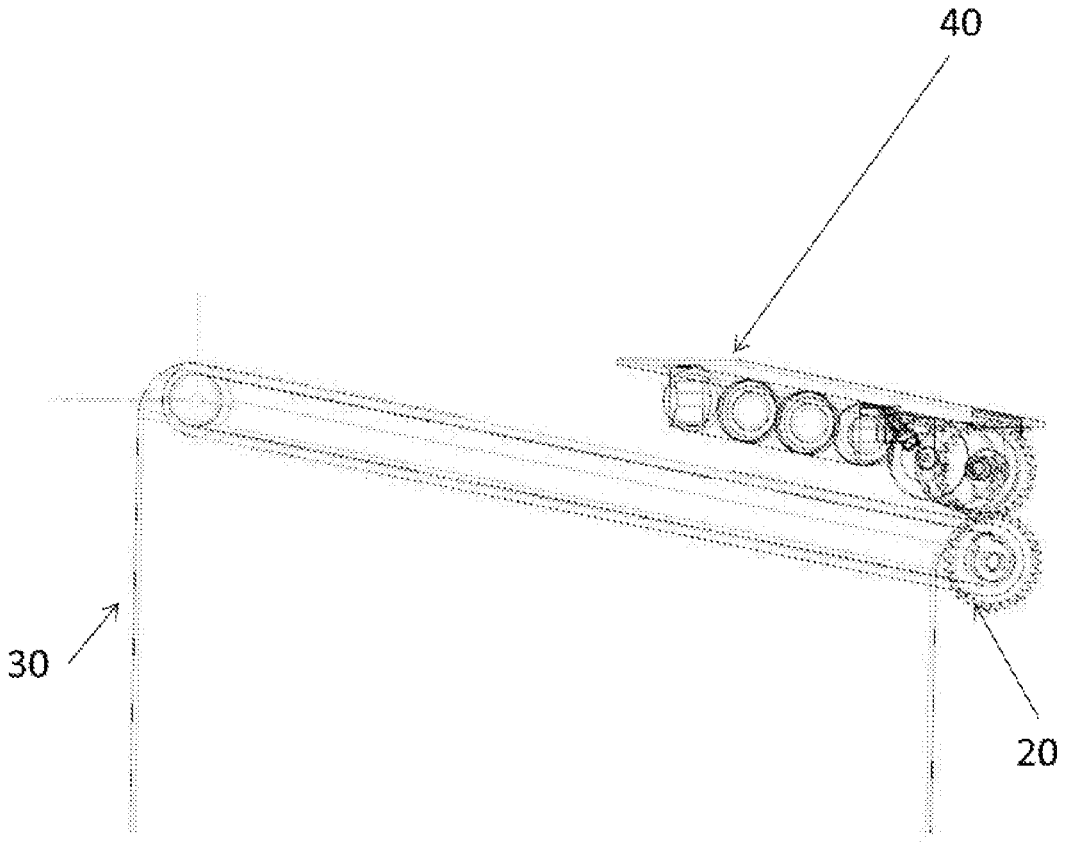
FIG. 3 is a perspective view of a window covering assembly according to one exemplary embodiment of the present invention.

FIGS. 1-3 show a window covering assembly according to one embodiment of the present invention. As shown in FIG. 1, the window covering assembly 10 may include a roller 20, around which a window cover 30 is wound. Upon rotation of the roller 20, window cover 30 is either raised or lowered, depending on the direction of rotation of roller 20. In one embodiment, window cover 30 is a screen; however, other window coverings may be used. For example, cellular blinds, as are commonly known in the art, may be used. In case of cellular blinds, the blinds are not wound around roller 20. Rather, a string that is attached to the bottom of the blinds is wound around a spool. Upon rotation of the spool, the bottom of the string is either raised or lowered, depending on the direction of rotation of the spool. This, in turn, either raises or lowers the cellular blinds.

As is also shown in FIG. 1, the window covering assembly 10 may include a motor assembly 40. In one embodiment, this assembly includes a motor which, when activated, causes a shaft to rotate. As shown in FIGS. 2 and 3, this shaft may be connected to a spur gear that interfaces with a matching spur gear on the roller 20. In this way, the roller is caused to rotate and thereby raise or lower the window cover 30. The present invention is not limited to the power transmission system just described. Other gearing mechanisms may be used, and other power transmission systems, including chain drives and belt drives, may be used.

As is also shown in FIG. 1, the window covering assembly 10 may include mounting brackets 51, 52. In one embodiment, these mounting brackets secure the roller 20 and motor assembly 40 to a window frame. A roller channel 60 and valance 70 may be placed over the roller 20 and motor assembly 40 when the window covering assembly 10 is installed in a window frame. This visually obscures the roller 20 and motor assembly 40, increasing the aesthetic appearance of the window covering assembly 10.

In one embodiment of the present invention, one or more powered modules may be attached to the window covering assembly 10. Exemplary powered modules include a light 81, temperature sensor 82, fan 83, heater 84, and motion detector 85. The window covering assembly 10 is configured to receive any configuration of these modules. This allows for a window covering assembly 10 with tailored features. For example, a window covering assembly 10 may include a motion detector and a light. Controls may be provided such that when a person walks in the vicinity of the window covering assembly, the light is turned on. As another example, a window covering assembly 10 may include a temperature sensor and a heater. Controls may be provided such that when the temperature sensor detects that the ambient temperature is below a certain threshold temperature, the heater is activated. It will be apparent to one of skill in the art that the preceding are only exemplary, and any combination of the powered modules may be employed in a window covering assembly 10.

In one embodiment, the modules are powered by a battery cell 86 that is integral to the window covering assembly 10. This battery cell may also be the source of power for the motor assembly 40.

In one embodiment, all of the modules that may be installed on a window covering assembly 10 have the same outer profile, and the window covering assembly has receptacles 87 configured to receive the modules. In this way, any module may be placed in any of the receptacles of the window covering assembly 10.

It will be apparent to those skilled in the art that various modifications and variations can be made in the modular motorized window blinds assembly of the present invention without departing from the spirit or scope of the invention. Thus, it is intended that the present invention cover modifications and variations of this invention provided they come within the scope of the appended claims and their equivalents.

What is claimed is:

1. A window covering assembly comprising:

a roller;

a motor assembly disposed proximate to the roller;

a window cover attached to the roller;

a receptacle installed on the window covering assembly;

a first powered module configured for placement in the receptacle, the first powered module configured to cause performance of a first task; and a second powered module configured for placement in the receptacle, the second powered module configured to cause performance of a second task that is different than the first task, wherein:

the window cover is raised when the roller rotates in a first angular direction, the window cover is lowered when the roller rotates in a second angular direction, opposite the first angular direction, the motor assembly interfaces with the roller via a power transmission system, the motor assembly is powered by a battery cell integral to the window covering assembly for actuating the power transmission system, the first powered module and the second powered module have a same outer profile for interchangeable installation within the receptacle, the first powered module and the second powered module are powered by the battery cell, the first powered module includes a light for performing the first task, and the second powered module includes a temperature sensor, a fan, a heater, or a motion sensor for performing the second task.

2. The window covering assembly according to claim 1, wherein the first powered module includes the light and the second powered module includes the heater.

3. The window covering assembly according to claim 1, further comprising a plurality of receptacles configured to receive the first powered module and the second powered module.

4. The window covering assembly according to claim 1, wherein the first powered module includes the light and the second powered module includes the temperature sensor.

5. The window covering assembly according to claim 1, wherein the first powered module includes the light and the second powered module includes the motion sensor.

6. A window covering assembly comprising:

a roller;

a motor assembly disposed proximate to the roller;

a window cover attached to the roller;

a receptacle installed on the window covering assembly;

a first powered module configured for placement in the receptacle, the first powered module configured to cause performance of a first task; and a second powered module configured for placement in the receptacle, the second powered module configured to cause performance of a second task that is different than the first task, wherein:

the window cover is raised when the roller rotates in a first angular direction, the window cover is lowered when the roller rotates in a second angular direction, opposite the first angular direction, the motor assembly interfaces with the roller via a power transmission system, the motor assembly is powered by a battery cell integral to the window covering assembly for actuating the power transmission system, the first powered module and the second powered module have a same outer profile for interchangeable installation within the receptacle, the first powered module and the second powered module are powered by the battery cell.

7. The window covering assembly according to claim 6, wherein:

the first powered module includes one of a light, a fan, and a heater, the second powered module includes one of a temperature sensor and a motion sensor, and the first powered module is activated based on a condition sensed by the second powered module.

* * * * *